US006457388B1

(12) United States Patent
Chen

(10) Patent No.: US 6,457,388 B1
(45) Date of Patent: Oct. 1, 2002

(54) CONTROL MEMBER FOR RATCHET WRENCH

(76) Inventor: Ching Chen, 1, Nong 2, Lane 741, Dong-Ping Rd., Tai-Ping City, Taichung Hsien (TW)

( * ) Notice: Subject to any disclaimer, the term of this patent is extended or adjusted under 35 U.S.C. 154(b) by 2 days.

(21) Appl. No.: 09/768,719

(22) Filed: Jan. 25, 2001

(51) Int. Cl.[7] ..... B25B 13/46
(52) U.S. Cl. ..... 81/63.2; 81/63
(58) Field of Search ..... 81/60, 61, 62, 81/63, 63.1, 63.2

(56) References Cited

U.S. PATENT DOCUMENTS 4,491,043 A * 1/1985 Dempsey et al. ..... 81/62
5,533,427 A * 7/1996 Chow ..... 81/63.2
5,957,009 A * 9/1999 McCann ..... 81/63.2
5,974,915 A * 11/1999 Chou ..... 80/63.1
6,161,454 A * 12/2000 Chaconas ..... 81/63.2
6,260,449 B1 * 7/2001 I-He ..... 81/63.2
6,282,991 B1 * 9/2001 Hu ..... 81/63.2

* cited by examiner

*Primary Examiner*—Eileen P. Morgan
*Assistant Examiner*—Joni B. Danganan
(74) *Attorney, Agent, or Firm*—Charles E. Baxley

(57) ABSTRACT

A ratchet wrench includes a wrench body having a drive head defining a first receiving space, a second receiving space, and a third receiving space. A ratchet wheel is rotatably mounted in the first receiving space and is provided with first teeth. A pawl member is movably mounted in the second receiving space and is provided with second teeth detachably meshing with the first teeth of the ratchet wheel. A control member includes a rotation cylinder rotatably mounted in the third receiving space, a linking lever secured on a first end of the rotation cylinder and pivotally mounted on the pawl member for moving the pawl member to engage with or detach from the ratchet wheel, and a drive handle secured on a second end of the rotation cylinder for driving the rotation cylinder to rotate.

12 Claims, 6 Drawing Sheets

CONTROL MEMBER FOR RATCHET WRENCH

BACKGROUND OF THE INVENTION

1. Field of the Invention

The present invention relates to a ratchet wrench.

2. Description of the Related Art

A conventional ratchet wrench in accordance with the prior art may be used to operate and rotate a workpiece such as a bolt, nut or the like along one direction only. The conventional ratchet wrench comprises a drive head, a ratchet wheel mounted in the drive head, a pawl engaged with the ratchet wheel, and a control knob mounted on the drive head for controlling the operation direction of the ratchet wheel. However, the control knob is usually mounted on and exposed from the top of the drive head, so that the control knob easily touches or tangles the objects located adjacent to the workpiece, thereby hindering or interrupting the operation of the ratchet wrench.

SUMMARY OF THE INVENTION

The present invention has arisen to mitigate and/or obviate the disadvantage of the conventional ratchet wrench.

In accordance with the present invention, there is provided a ratchet wrench comprising:

- a wrench body having a shank, and a drive head mounted on one end of the shank, the drive head defining a first receiving space, a second receiving space, and a third receiving space;
- a ratchet wheel rotatably mounted in the first receiving space of the drive head of the wrench body, and having an outer wall provided with first teeth;
- a pawl member movably mounted in the second receiving space of the drive head of the wrench body, and having one side provided with second teeth detachably meshing with the first teeth of the ratchet wheel; and
- a control member including a rotation cylinder rotatably mounted in the third receiving space of the drive head of the wrench body, a linking lever secured on a first end of the rotation cylinder and pivotally mounted on the pawl member for moving the pawl member to engage with or detach from the ratchet wheel, and a drive handle secured on a second end of the rotation cylinder for driving the rotation cylinder to rotate.

Further benefits and advantages of the present invention will become apparent after a careful reading of the detailed description with appropriate reference to the accompanying drawings.

DETAILED DESCRIPTION OF THE INVENTION

Figure 1:
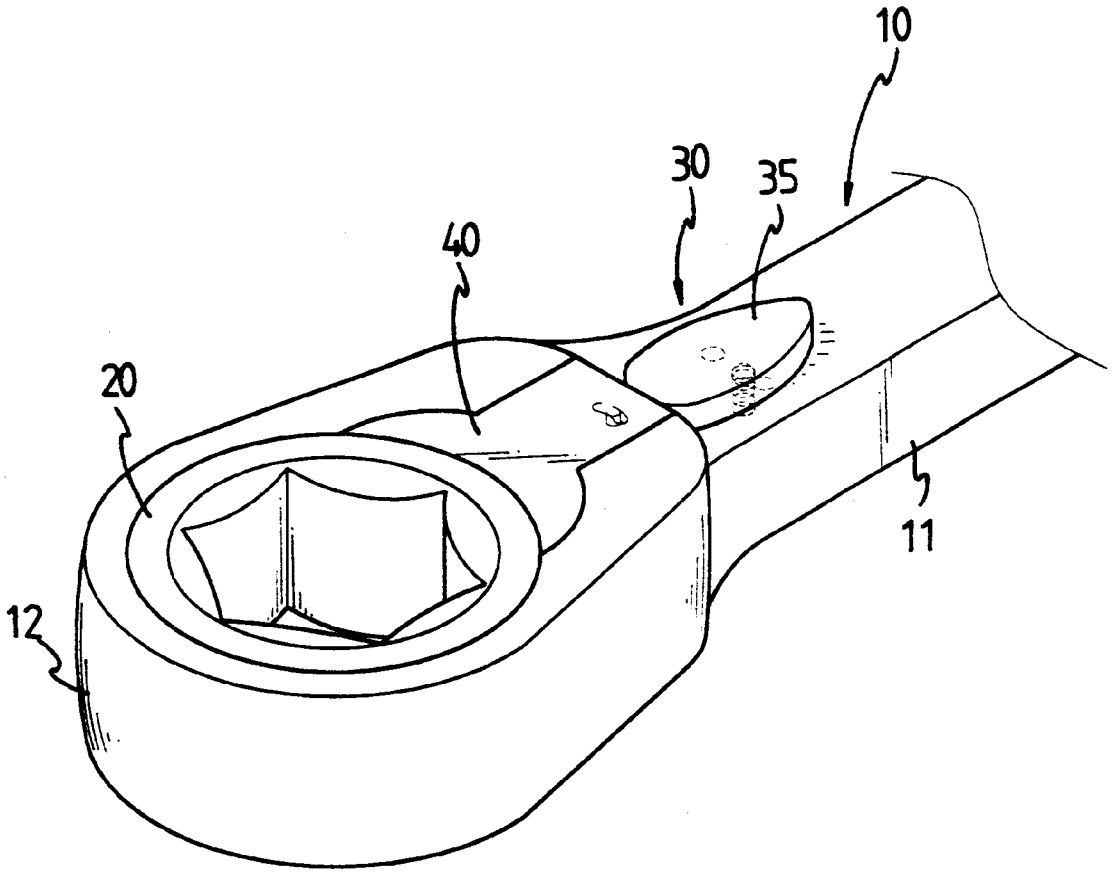
FIG. 1 is a perspective view of a ratchet wrench in accordance with the present invent.

Referring to the drawings and initially to FIGS. 1–4, a ratchet wrench in accordance with the present invention comprises a wrench body 10, a ratchet wheel 20, a pawl member 24, and a control member 30.

The wrench body 10 includes a shank 11, and a drive head 12 mounted on one end of the shank 11. The drive head 12 defines a first receiving space 120, a second receiving space 121, and a third receiving space 123 connecting with each other.

The ratchet wheel 20 is rotatably mounted in the first receiving space 120 of the drive head 12 of the wrench body 10, and has an inner wall defining a hexagonal recess 22 and an outer wall provided with first teeth 21.

The drive head 12 of the wrench body 10 has a top defining an annular groove 128, and the ratchet wrench further comprises a C-shaped snap ring 28 secured in the annular groove 128 and rested on the top of the ratchet wheel 20. The first receiving space 120 of the drive head 12 of the wrench body 10 is provided with an annular flange 129 extending radialy inward for supporting the ratchet wheel 20.

The pawl member 24 is movably mounted in the second receiving space 121 of the drive head 12 of the wrench body 10, and has a first side wall provided with second teeth 21 detachably meshing with the first teeth 25 of the ratchet wheel 20.

The control member 30 includes a rotation cylinder 31 rotatably mounted in the third receiving space 123 of the drive head 12 of the wrench body 10, a linking lever 34 secured on a first end of the rotation cylinder 31 and pivotally mounted on the pawl member 24 for moving the pawl member 24 to engage with or detach from the ratchet wheel 20, and a drive handle 35 secured on a second end of the rotation cylinder 31 for driving the rotation cylinder 31 to rotate.

The pawl member 24 is provided with a pivot stub 26 protruding outward therefrom, and the linking lever 34 of the control member 30 defines a pivot hole 340 for pivotally and movably receiving the pivot stub 26 of the pawl member 24 therein.

The drive handle 35 of the control member 30 defines a first positioning hole 350 and a second positioning hole 352 spaced from the first positioning hole 350. The shank 11 of the wrench body 10 defines a receiving hole 110. The ratchet wrench further comprises a positioning ball 50 movably mounted in the receiving hole 110 of the shank 11 of the wrench body 10 and detachably locked in one of the first positioning hole 350 and the second positioning hole 352 of the drive handle 35 of the control member 30, and a biasing member 52 mounted in the receiving hole 110 of the shank 11 of the wrench body 10 and urged between the positioning ball 50 and a wall of the receiving hole 110 of the shank 11 of the wrench body 10.

The third receiving space 123 of the drive head 12 of the wrench body 10 defines a circular hole 124 for receiving the rotation cylinder 31 of the control member 30 therein. The drive head 12 of the wrench body 10 defines a channel 125 connecting to the circular hole 124. The rotation cylinder 31 of the control member 30 includes a rotation column 32 rotatably mounted in the channel 125. The ratchet wrench further comprises a C-shaped snap member 33 secured on the lower end of the rotation column 32 and rested on the bottom of the drive head 12 of the wrench body 10. The bottom of the drive head 12 of the wrench body 10 preferably defines a positioning recess 126 connecting to the channel 125 for securing the snap member 33 therein. The lower end of the rotation column 32 defines an annular groove 320 for securing the snap member 33 therein.

A cover 40 is mounted on the top of the drive head 12 of the wrench body 10 and rested on the top of the control member 30. The cover 40 is provided with an axle 42 protruding outward, and the rotation cylinder 31 of the control member 30 defines an arcuate slot 310 for movably receiving the axle 42 of the cover 40 therein.

The second receiving space 121 of the drive head 12 of the wrench body 10 has a side wall defining a receiving hole 122. The ratchet wrench further comprises an urging ball 60 movably mounted in the receiving hole 122 of the second receiving space 121 of the drive head 12 of the wrench body 10 and urged on a second side wall of the pawl member 24, and a biasing member 62 mounted in the receiving hole 122 of the second receiving space 121 of the drive head 12 of the wrench body 10 and urged between the urging ball 60 and a wall of the receiving hole 122 of the second receiving space 121 of the drive head 12 of the wrench body 10.

Figure 2:
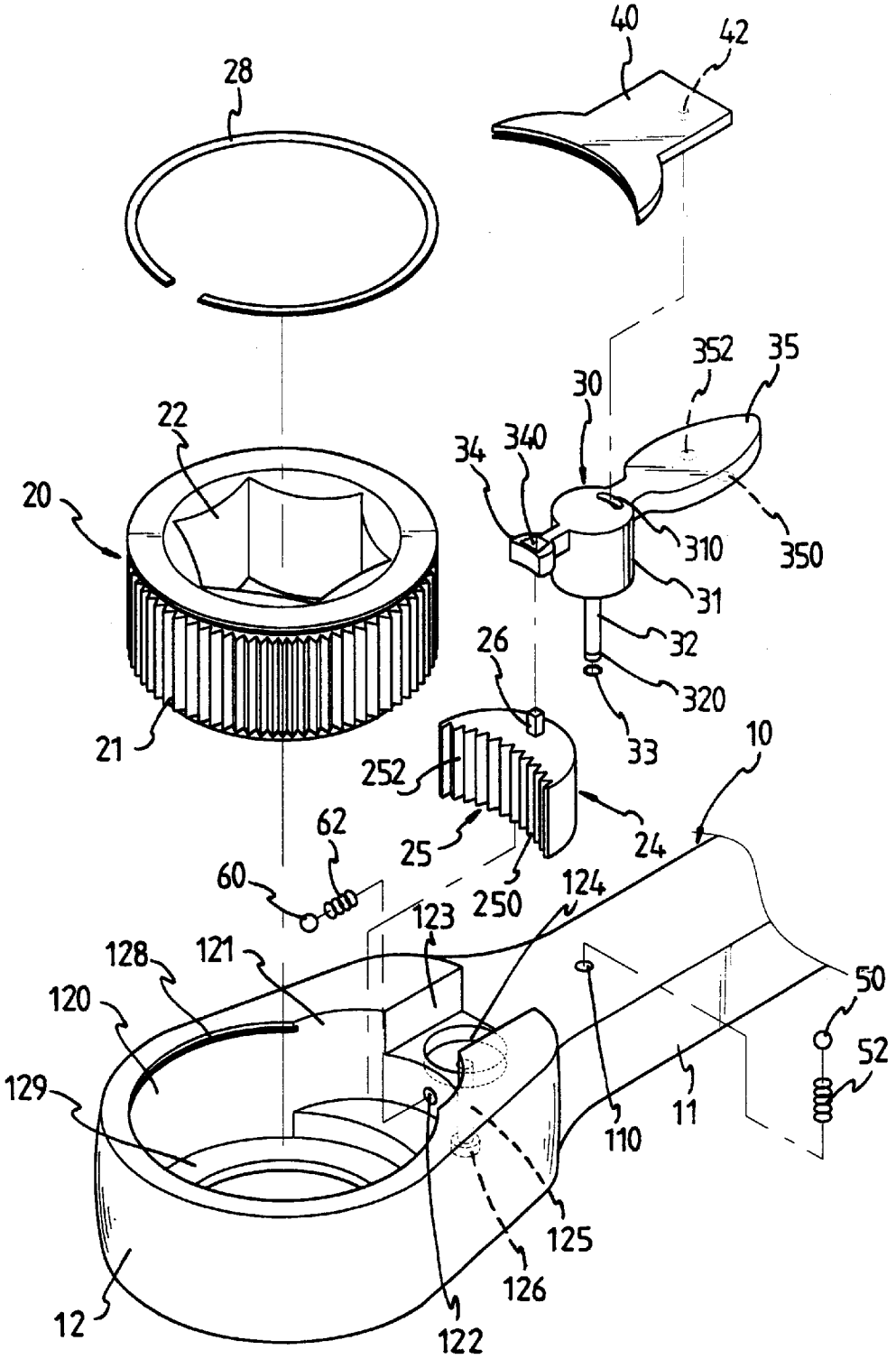
FIG. 2 is an exploded perspective view of the ratchet wrench as shown in FIG. 1
Figure 3:
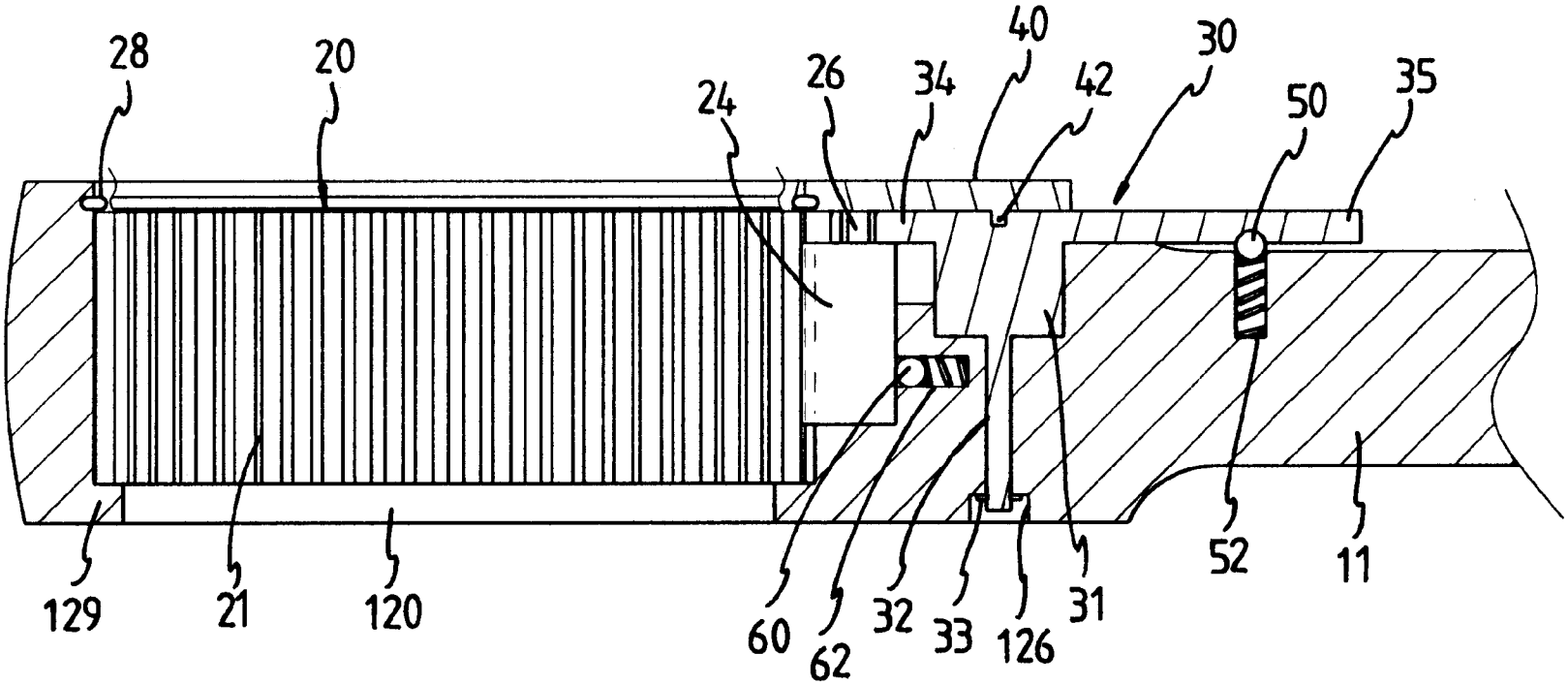
FIG. 3 is a front plan cross-sectional view of the ratchet wrench as shown in FIG. 1
Figure 4:
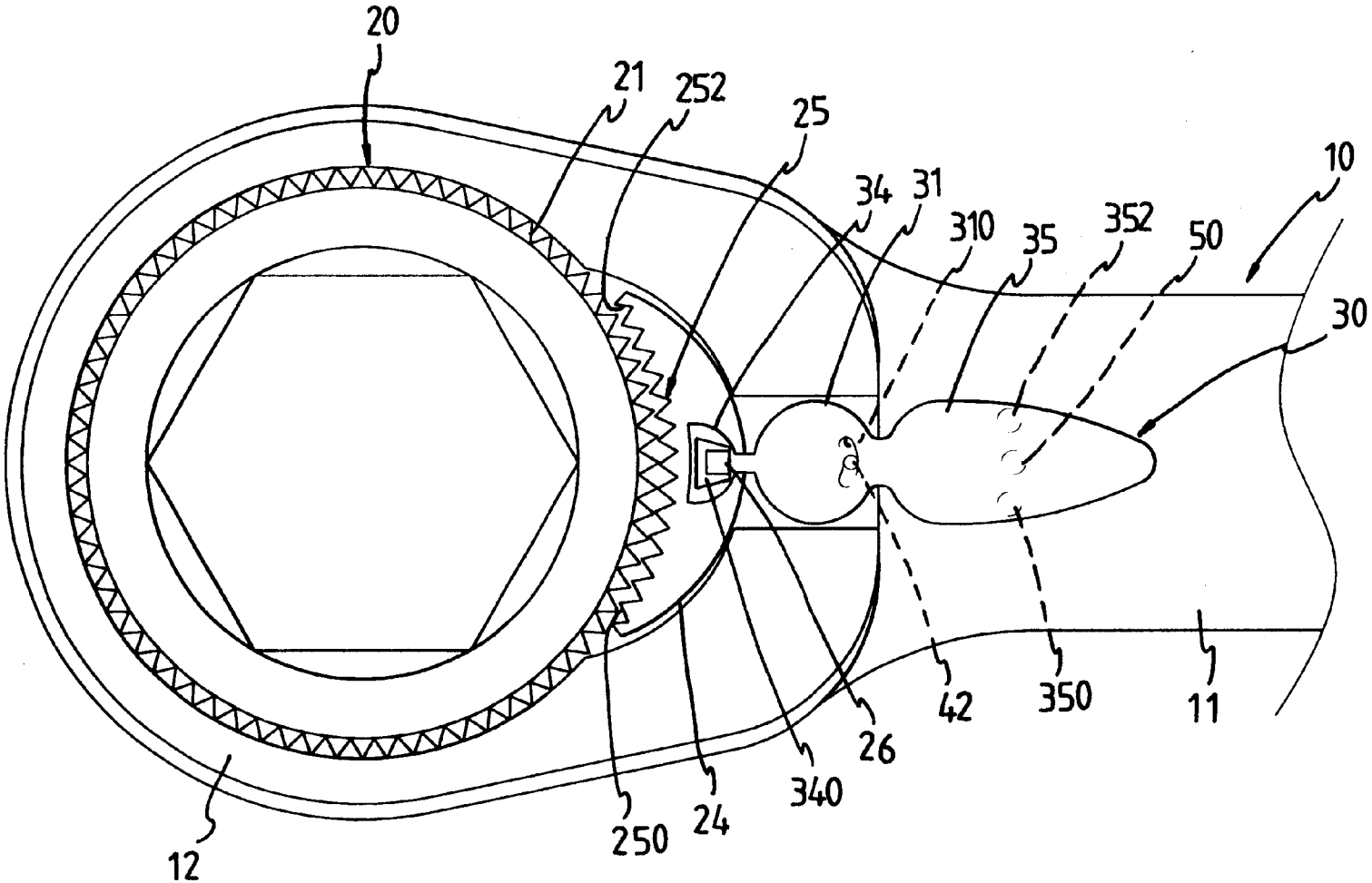
FIG. 4 is a top plan cross-sectional view of the ratchet wrench as shown in FIG. 1.
Figure 5:
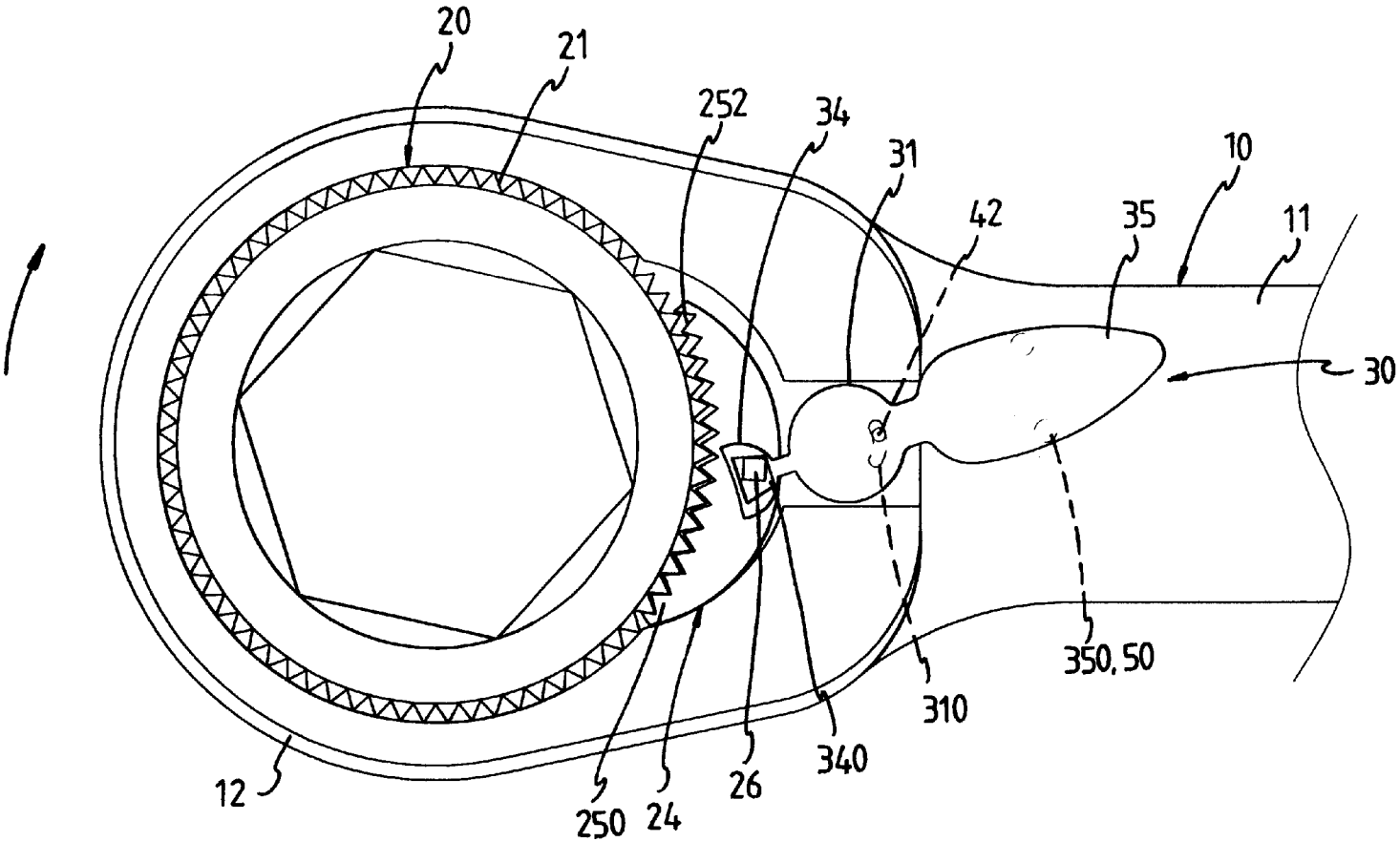
FIG. 5 is an operational view of the ratchet wrench as shown in FIG. 4 in use.
Figure 6:
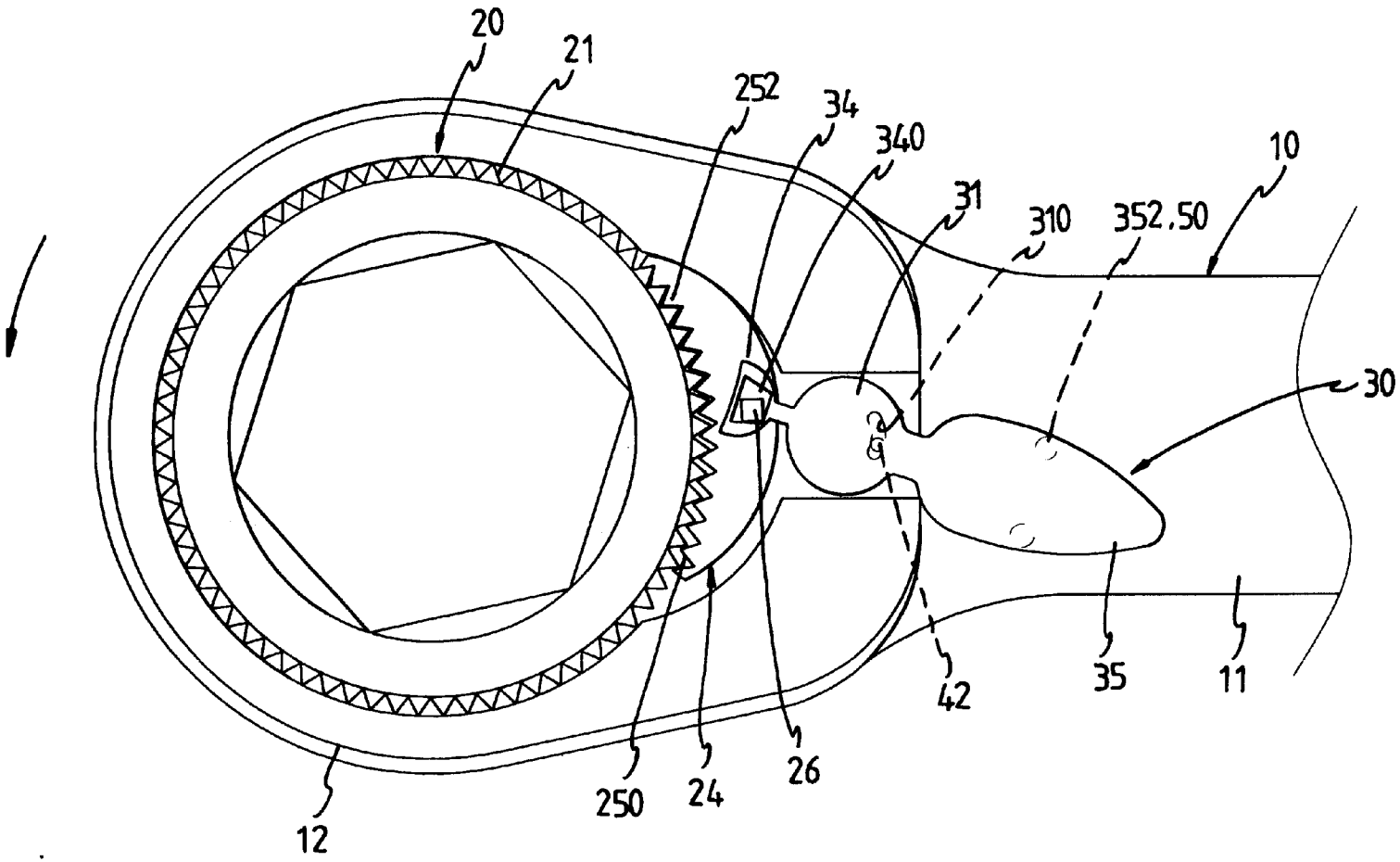
FIG. 6 is an operational view of the ratchet wrench as shown in FIG. 4 in use.

In operation, referring to FIGS. 4–6 with reference to FIGS. 1–3, the control member 30 is initially disposed at the state as shown FIG. 4 whereby the second teeth 25 of the pawl member 24 is not in contact with the first teeth 21 of the ratchet wheel 20, so that the ratchet wheel 20 idles.

The operator can move the drive handle 35 of the control member 30 from the position as shown in FIG. 4 to the position as shown in FIG. 5 where the positioning ball 50 is inserted into and locked in the first positioning hole 350 for positioning the drive handle 35 in place. At the same time, the rotation cylinder 31 of the control member 30 is rotated to move the linking lever 34 which moves the pawl member 24 by pivotal connection between the pivot stub 26 and the pivot hole 340 to the position as shown in FIG. 5 where a first portion 250 of the teeth 25 of the pawl member 24 engages with the teeth 21 of the ratchet wheel 20. In such a manner, the drive head 12 of the wrench body 10 can be rotated to drive the ratchet wheel 29 to rotate clockwise as indicated by the arrow in FIG. 5 for rotating a workpiece such as a nut, a bolt or the like along the clockwise direction. When the drive head 12 of the wrench body 10 is rotated counterclockwise, the ratchet wheel 20 idles.

Alternatively, the operator can also move the drive handle 35 of the control member 30 from the position as shown in FIG. 4 to the position as shown in FIG. 6 where the positioning ball 50 is inserted into and locked in the second positioning hole 352 for positioning the drive handle 35 in place. At the same time, the rotation cylinder 31 of the control member 30 is rotated to move the linking lever 34 which moves the pawl member 24 by pivotal connection between the pivot stub 26 and the pivot hole 340 to the position as shown in FIG. 6 where a second portion 252 of the teeth 25 of the pawl member 24 engages with the teeth 21 of the ratchet wheel 20. In such a manner, the drive head 12 of the wrench body 10 can be rotated to drive the ratchet wheel 29 to rotate counterclockwise as indicated by the arrow in FIG. 6 for rotating the workpiece along the counterclockwise direction. When the drive head 12 of the wrench body 10 is rotated clockwise, the ratchet wheel 20 idles.

Accordingly, in accordance with the present invention, the ratchet wrench can be easily and rapidly operated to rotate the workpiece. In addition, most of the control member 30 is hidden in the cover 40, and only the drive handle 35 is exposed outward from the cover 40 as shown in FIG. 1, whereby the control member 30 will not touch objects located adjacent to the workpiece, such that existence of the control member 30 will not hinder operation of the ratchet wrench. Further, the positioning ball 50 may be selectively locked in either one of the first positioning hole 350 and the second positioning hole 352 for positioning the drive handle 35 of the control member 30 in place, so that the ratchet wrench can be operated stably and rigidly.

It should be clear to those skilled in the art that further embodiments may be made without departing from the scope of the present invention.

What is claimed is:

1. A ratchet wrench comprising:

a wrench body (10) having a shank (11), and a drive head (12) mounted on one end of said shank (11), said drive head (12) defining a first receiving space (120), a second receiving space (121), and a third receiving space (123);

a ratchet wheel (20) rotatably mounted in said first receiving space (120) of said drive head (12) of said wrench body (10), and having an outer wall provided with first teeth (21);

a pawl member (24) movably mounted in said second receiving space (121) of said drive head (12) of said wrench body (10), and having one side provided with second teeth (25) detachably meshing with said first teeth (25) of said ratchet wheel (20), a pivot stub (26) protruding outward therefrom; and a control member (30) including a rotation cylinder (31) rotatably mounted in said third receiving space (123) of said drive head (12) of said wrench body (10), a linking lever (34) secured on a first end of said rotation cylinder (31) and having a pivot hole (340) defined therein, said pivot stub (26) of said pawl member (24) being pivotally received in said pivot hole (340) so as to move said pawl member (24) to engage with or detach from said ratchet wheel (20), and a drive handle (35) secured on a second end of said rotation cylinder (31) for driving said rotation cylinder (31) to rotate.

2. The ratchet wrench in accordance with claim 1, wherein said drive handle (35) of said control member (30) defines a first positioning hole (350) and a second positioning hole (352) spaced from said first positioning hole (350), said shank (11) of said wrench body (10) defines a receiving hole (1100), and said ratchet wrench further comprises a positioning ball (50) movably mounted in said receiving hole (110) of said shank (11) of said wrench body (10) and detachably locked in one of said first positioning hole (350) and said second positioning hole (352) of said drive handle (35) of said control member (30), and a biasing member (52) mounted in said receiving hole (110) of said shank (11) of said wrench body (10) and urged between said positioning ball (50) and a wall of said receiving hole (110) of said shank (11) of said wrench body (10).

3. The ratchet wrench in accordance with claim 1, wherein said third receiving space (123) of said drive head (12) of said wrench body (10) defines a circular hole (124) for receiving said rotation cylinder (31) of said control member (30) therein.

4. The ratchet wrench in accordance with claim 3, wherein said drive head (12) of said wrench body (10) defines a channel (125) connecting to said circular hole (124), said rotation cylinder (31) of said control member (30) is provided with a rotation column (32) rotatably mounted in said channel (125), and said ratchet wrench further comprises a snap member (33) secured on a lower end of said rotation column (32) and rested on a bottom of said drive head (12) of said wrench body (10).

5. The ratchet wrench in accordance with claim 4 wherein said bottom of said drive head (12) of said wrench body (10)

defines a positioning recess (126) connecting to said channel (125) for securing said snap member (33) therein.

6. The ratchet wrench in accordance with claim 4, wherein said lower end of said rotation column (32) defines an annular groove (320) for securing said snap member (33) therein.

7. The ratchet wrench in accordance with claim 1, further comprising a cover (40) mounted on a top of said drive head (12) of said wrench body (10) and rested on a top of said control member (30).

8. The ratchet wrench in accordance with claim 7, wherein said cover (40) is provided with an axle (42) protruding outward, and said rotation cylinder (31) of said control member (30) defines an arcuate slot (310) for movably receiving said axle (42) of said cover (40) therein.

9. The ratchet wrench in accordance with claim 1, wherein said second receiving space (121) of said drive head (12) of said wrench body (10) has a side wall defining a receiving hole (122), and said ratchet wrench further comprises an urging ball (60) movably mounted in said receiving hole (122) of said second receiving space (121) of said drive head (12) of said wrench body (10) and urged on a side wall of said pawl member (24), and a biasing member (62) mounted in said receiving hole (122) of said second receiving space (121) of said drive head (12) of said wrench body (10) and urged between said urging ball (60) and a wall of said receiving hole (122) of said second receiving space (121) of said drive head (12) of said wrench body (10).

10. The ratchet wrench in accordance with claim 1, wherein said drive head (12) of said wrench body (10) has a top defining an annular groove (128), and said ratchet wrench further comprises a C-shaped snap ring (28) secured in said annular groove (128) and rested on a top of said ratchet wheel (20).

11. The ratchet wrench in accordance with claim 1, wherein said first receiving space (120) of said drive head (12) of said wrench body (10) is provided with an annular flange extending radially inward for supporting said ratchet wheel (20).

12. A ratchet wrench comprising:

a wrench body (10) having a shank (11), and a drive head (12) mounted on one end of said shank (11), said drive head (12) defining a first receiving space (120), a second receiving space (121), and a third receiving space (123);

a ratchet wheel (20) rotatably mounted in said first receiving space (120) of said drive head (12) of said wrench body (10), and having an outer wall provided with first teeth (21);

a pawl member (24) movably mounted in said second receiving space (121) of said drive head (12) of said wrench body (10), and having one side provided with second teeth (25) detachably meshing with said first teeth (25) of said ratchet wheel (20);

a control member (30) including a rotation cylinder (31) rotatably mounted in said third receiving space (123) of said drive head (12) of said wrench body (10), a linking lever (34) secured on a first end of said rotation cylinder (31) and pivotally mounted on said pawl member (24) for moving said pawl member (24) to engage with or detach from said ratchet wheel (20), and a drive handle (35) secured on a second end of said rotation cylinder (31) for driving said rotation cylinder (31) to rotate, and a cover (40) mounted on a top of said drive head (120 of said wrench body (10) and rested on a top of said control member (30).

* * * * *